US008914995B2

(12) United States Patent
Andrews

(10) Patent No.: US 8,914,995 B2
(45) Date of Patent: Dec. 23, 2014

(54) FOOT ORTHOTIC

(75) Inventor: Anthony Clive Andrews, London (GB)

(73) Assignee: Orthotics Online Limited, London (GB)

( * ) Notice: Subject to any disclaimer, the term of this patent is extended or adjusted under 35 U.S.C. 154(b) by 1121 days.

(21) Appl. No.: 11/988,804

(22) PCT Filed: Jul. 17, 2006

(86) PCT No.: PCT/GB2006/002651

§ 371 (c)(1),
(2), (4) Date: May 21, 2009

(87) PCT Pub. No.: WO2007/010232

PCT Pub. Date: Jan. 25, 2007

(65) Prior Publication Data

US 2010/0000122 A1 Jan. 7, 2010

(30) Foreign Application Priority Data

Jul. 15, 2005 (GB) ..... 0514578.4
Nov. 29, 2005 (GB) ..... 0524244.1

(51) Int. Cl.

| | |
|---|---|
| ***A43B 13/38*** | (2006.01) |
| ***A43B 7/14*** | (2006.01) |
| ***A43B 13/10*** | (2006.01) |
| ***A43B 17/00*** | (2006.01) |
| ***A43B 17/04*** | (2006.01) |

(52) U.S. Cl.

CPC ..... *A43B 13/10* (2013.01); *A43B 7/144* (2013.01); *A43B 17/003* (2013.01); *A43B 17/04* (2013.01)

USPC ..... 36/43; 36/152; 36/140

(58) Field of Classification Search

CPC .... A43B 7/144; A43B 7/1435; A43B 7/1445; A43B 7/145; A43B 7/1455; A43B 7/1405; A43B 7/141; A43B 7/142; A43B 7/22; A43B 17/00; A43B 17/003; A43B 17/04

USPC ..... 36/43, 44, 71, 140–152, 175–177

See application file for complete search history.

(56) References Cited

U.S. PATENT DOCUMENTS

| | | | | |
|---|---|---|---|---|
| 1,772,364 | A * | 8/1930 | Peterson | 36/177 |
| 1,983,630 | A | 12/1934 | Matthias | |
| 4,015,347 | A * | 4/1977 | Morishita et al. | 36/44 |
| 4,631,841 | A * | 12/1986 | Hickey | 36/91 |
| 4,729,179 | A * | 3/1988 | Quist, Jr. | 36/44 |
| 5,611,153 | A | 3/1997 | Fisher et al. | |
| 6,216,365 | B1 * | 4/2001 | Cohen | 36/44 |
| 6,315,786 | B1 * | 11/2001 | Smuckler | 606/201 |
| 6,804,902 | B1 * | 10/2004 | McCracken et al. | 36/155 |
| 6,915,598 | B2 * | 7/2005 | Grisoni et al. | 36/151 |

(Continued)

FOREIGN PATENT DOCUMENTS

| | | |
|---|---|---|
| GB | 280728 | 11/1927 |
| GB | 2066048 | 7/1981 |

(Continued)

OTHER PUBLICATIONS

English Abstract of KR20010090982.

(Continued)

*Primary Examiner* — Jila M Mohandesi

(74) *Attorney, Agent, or Firm* — Harness, Dickey & Pierce, P.L.C.

(57) ABSTRACT

A foot orthotic for use as an insole in footwear is made solely from a copper-containing material.

9 Claims, 4 Drawing Sheets

(56) References Cited

U.S. PATENT DOCUMENTS

| | | | | |
|---|---|---|---|---|
| 6,966,131 | B2 * | 11/2005 | McCracken et al. | 36/155 |
| 7,140,126 | B2 * | 11/2006 | Crane et al. | 36/43 |
| 7,458,173 | B2 * | 12/2008 | Kielt et al. | 36/44 |
| 7,685,744 | B2 * | 3/2010 | Lundy et al. | 36/44 |
| 2004/0123498 | A1 * | 7/2004 | Lietzman | 36/145 |
| 2007/0074430 | A1 * | 4/2007 | Coomer | 36/145 |

FOREIGN PATENT DOCUMENTS

| | | |
|---|---|---|
| JP | 51051525 | 5/1976 |
| JP | 06007207 A * | 1/1994 |
| JP | 3049018 | 3/1998 |
| JP | 2001008707 | 1/2001 |
| KR | 20010090982 | 10/2001 |

OTHER PUBLICATIONS

English Abstract of JP2001008707.

English translation of paragraph 0014 of JP3049018.

Arthritis: My Miracle Cure—Crippled by arthritis, but magic copper cure got me up and running Sarah Westcott As seen in the Daily Express on Nov. 10, 2012.

* cited by examiner

FOOT ORTHOTIC

BACKGROUND OF THE INVENTION

1. Field of the Invention

This invention relates to a foot orthotic and, in particular, a foot orthotic for use as an insole in footwear.

2. The Prior Art

Insoles for footwear are well known. In fact, practically all footwear has an insole provided as part of the footwear, for example, this being provided as a cushioned layer between a person's foot and the inner portion of the sole of the footwear. It is also well known to provide additional insoles to provide further cushioning and/or to replace worn insoles.

The element copper is known to be useful in alleviating joint and arthritic pain. Whilst it is not intended to be bound by theory, it is believed that the properties/minerals contained within the copper provide an effect which can alleviate joint and arthritic pain. Further, sufferers from this type of pain often employ the use of a copper bracelet, which it is asserted aids pain relief.

Some insoles have been produced which include amounts of copper as under layers, most of which under layer is not directly contactable by a foot or sock of a foot. These insoles are, typically, elastically deformable, as they are made of relatively soft material, such that, when a person's foot presses on the insole, it deforms to the shape of the foot under weight and returns (substantially) to its normal shape after use. Incorporation of copper into these soft materials is often complex and numerous production steps are needed to provide the finished article.

Therefore, there is a need for an insole which includes an amount of copper but which is simple to manufacture and also comfortable for a person to use in their footwear.

SUMMARY OF THE INVENTION

Accordingly, in an aspect the invention provides, a foot orthotic, for use as an insole in footwear, anatomically-shaped to the plantar region of a foot, wherein the foot orthotic is made solely from a copper-containing material.

Preferably, the foot orthotic comprises a portion shaped to receive a heel, such as, a cup-shaped heel portion.

Preferably, the foot orthotic comprises a portion shaped to receive at least part of the arch of a foot, such as, an arched portion, which extends upwards into the arch of a foot.

Most preferably, the foot orthotic is a three-quarter length orthotic and extends from the heel to end around before the metatarsal heads of a foot.

Advantageously, the foot orthotic is bevelled.

An edge of the foot orthotic may be up-turned relative to an underside of the foot orthotic. Advantageously, this may provide the foot orthotic with increased resilience and/or reduce undesired bending.

Preferably, the foot orthotic is of uniform thickness.

Most preferably, the foot orthotic is made from a material of thickness from 0.5 mm to 1.5 mm, from 1.0 mm to 1.2 mm or, even further preferably, the thickness is 1.0 mm or 1.2 mm.

Preferably, the copper-containing material is an alloy of copper and/or contains from 30% to around 100% copper, preferably from 50% or 80% to around 100% copper, or, most preferably, 99.9% copper.

The foot orthotic may be made from a process of stamping and pressing a blank of copper-containing material to achieve the desired anatomical shape. As such, the blank of copper-containing material may be rolled or passed through a machine press after stamping to cut out the approximate shape.

Most preferably, the foot orthotic comprises an adhesive pad on an underside thereof, so as to reduce movement of the foot orthotic within a piece of footwear. In a further embodiment, two adhesive pads are provided.

In a second aspect, the invention provides a method of making a foot orthotic of the present invention; comprising providing a blank of copper-containing material by stamping out the blank from a sheet of copper-containing material and pressing the blank to achieve the desired anatomical shape.

Preferably, pressing of the blank of copper-containing material is achieved using rolling or a machine press. An edge of the foot orthotic may be bevelled and/or polished, to aid comfort of a wearer.

Preferably, the foot orthotic of the present invention or method described, is provided as an insole in an item of footwear; and is located in the region of the heel or back of the footwear.

BRIEF DESCRIPTION OF THE DRAWINGS

In order that the invention may be fully disclosed, embodiments will now be described, by way of example only, with reference to the accompanying drawings, in which.

DETAILED DESCRIPTION OF THE PREFERRED EMBODIMENTS

An insole (foot orthotic) is, generally, indicated in the Figures by reference 100. The insole 100 is provided with a heel portion 1 and an arched portion 2, and can be placed in an item of footwear, in or around the region of the heel or back of the footwear.

Figure 1:
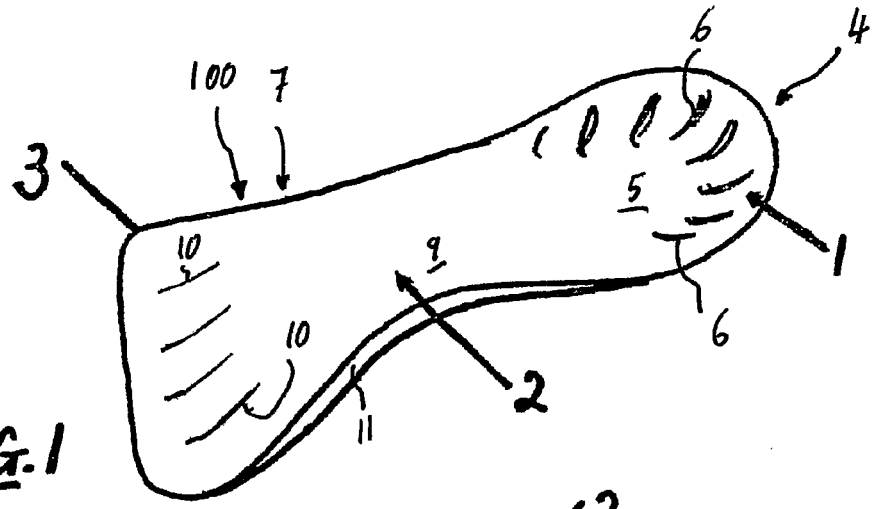
FIG. 1 is a perspective view of a foot orthotic according to the present invention, from above.
Figure 2:
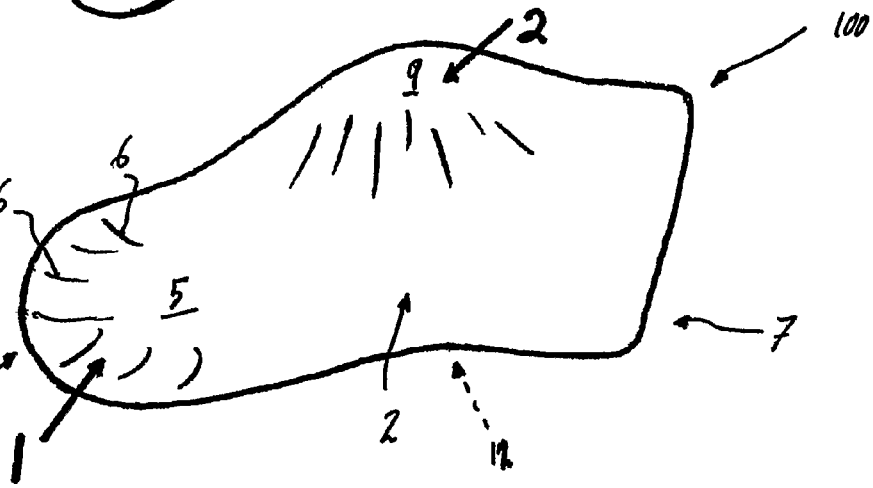
FIG. 2 is a perspective view of a second side of the foot orthographic of FIG. 1, from above.
Figure 3:
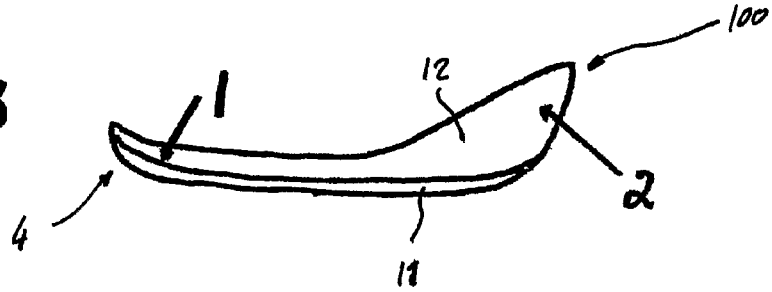
FIGS. 3 and 4 are respective side views of the foot orthotic of FIG. 1.
Figure 4:
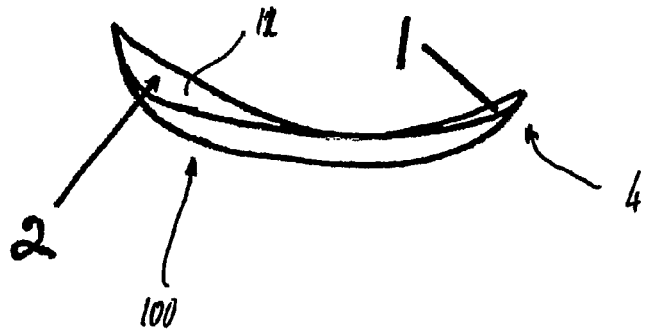
Figure 5:
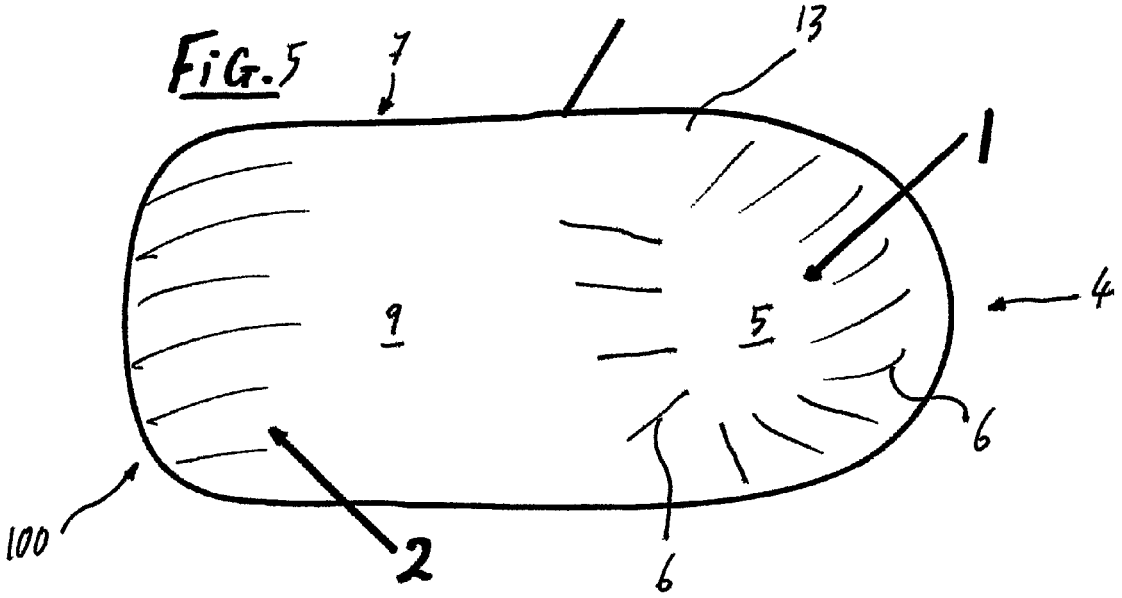
FIG. 5 is a plan view of the foot orthotic of FIG. 1.
Figure 6:
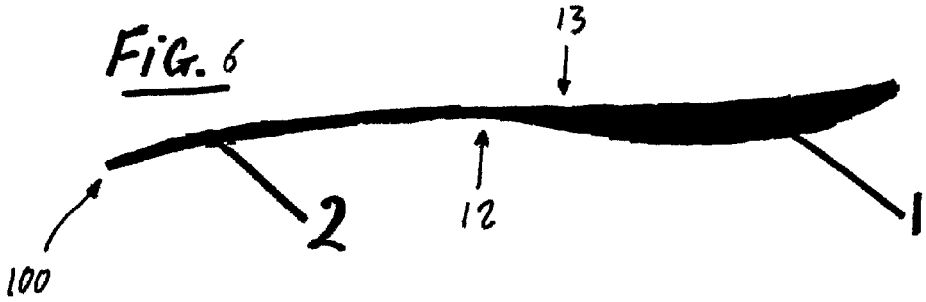
FIG. 6 is a further side view of the foot orthotic of FIG. 1, showing variations in depth of the shaped orthotic.
Figure 7:
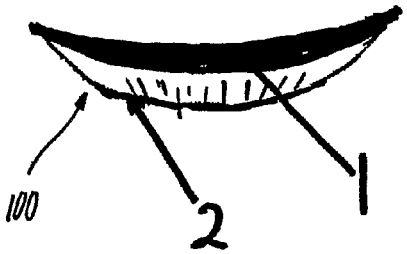
FIG. 7 is an end view of the foot orthotic of FIG. 1.
Figure 8:
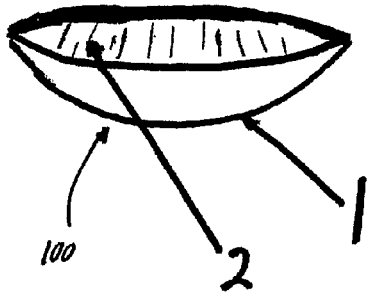
FIG. 8 is an opposite end view of the foot orthotic of FIG. 1.
Figure 9:
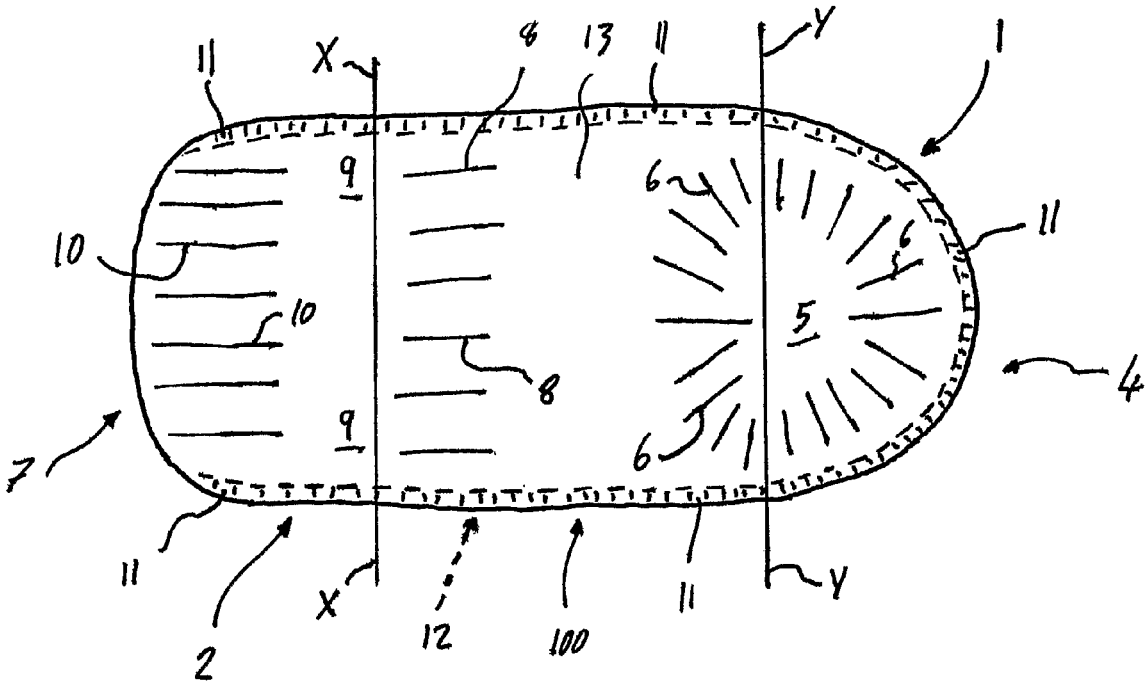
FIG. 9 is a further plan view of the foot orthotic of FIG. 1.
Figure 10:
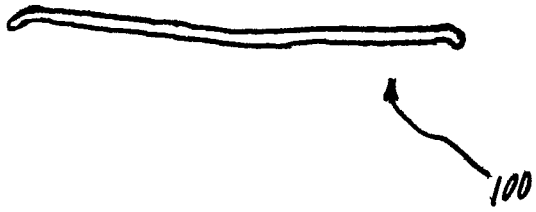
FIG. 10 is a cross-sectional view of the foot orthotic of FIG. 1, shown along the line X-X of FIG. 9.
Figure 11:
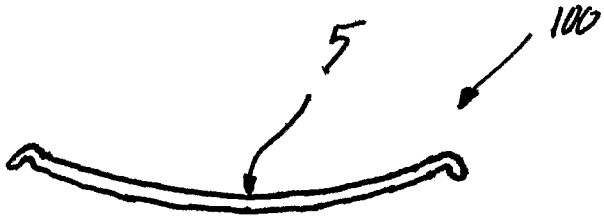
FIG. 11 is a cross sectional view along the line Y-Y of FIG. 9.

The heel portion 1 is located to the rear of the insole 100, as indicated by reference 4, and is provided with a heel cup 5. The heel cup 5 is shaped to receive the heel of a wearer of a piece of footwear. The heel cup 5 is provided as an indent in the insole 100. The heel cup 5 is, as its name suggests, cup-shaped, having a lowest point in or around the region of reference 5. The lines shown by reference 6 are intended to indicate that those portions surrounding the heel cup are downwardly sloped towards reference 5. FIG. 11 shows, in particular, the insole 100 through a cross-section along the line Y-Y. In this cross-section, the cup-shaped nature of the heel cup 5 is shown. The heel cup 5 is provided to make the insole 100 comfortable for a wearer of footwear.

The arched portion 2 is provided towards a front end of the insole 100, as indicated by reference 7. The arched portion 2 is shaped to receive at least part of the arch of a foot of a wearer of the piece of footwear. In an alternative embodiment, and as shown in FIGS. 1 to 4, the arched portion may be provided on one side only and is intended to support a fallen arch of a wearer of footwear and/or prevent, or at least substantially reduce, foot pain, knee pain and/or lower back pain. Most preferably, however, the arched portion is provided across the entire width of the insole, as shown in FIGS. 5 to 11. Ideally, the insoles are not foot specific and there is no specific left or right insole. A continual gradient is provided from the heel cup 5, as shown initially by lines at reference 6, and further shown by lines referenced by number 8 in FIG. 9. The highest point of the arched portion 2 is shown in the region of reference number 9. The arched portion 2, in the region of reference 9, extends upwardly and into an arch of the foot of a wearer of footwear. A front 3 of the insole 100 is provided at a lower level than the arched portion 2. Lines numbered 10 in the Figures are intended to show a downward gradient from the region of the arched portion 2 towards the front 3.

Apart from at the front 3, the insole is provided with an up-turned edge 11, relative to an underside 12 of the insole 100. Equally, the up-turned edge 11 may be seen as a downward-turned edge 11, relative to the upper surface 13 of the insole 100. The up-turned edge 11 runs along both sides and the rear portion of the insole 100, but not at the very front 3. The up-turned edge is provided both for comfort to a user of the insole and aids resilience of the insole under stress, when a user is wearing footwear in which the insole is placed.

The peripheral edge of the insole 100 is bevelled and/or polished to remove sharp edges, and make the insole more comfortable to a wearer.

In accordance with the invention, the insole 100 is made solely from a copper-containing material. Therefore, although the material must contain copper, it may contain other elements in varying proportions. Preferably, the copper-containing material is pure copper or, substantially, pure copper. Most preferably, the copper-containing material is 99.9% copper.

Most preferably, the insole 100 is formed entirely from one piece of copper-containing material.

The insole 100 is a three-quarter length orthotic, as is known in the art. This three-quarter length orthotic extends from the heel of a wearer to end before the metatarsal heads.

In a further embodiment, the insole 100 is provided with adhesive pads on the underside 12, such that the insole 100 may be affixed to the inside of a piece of footwear. Preferably, the insole 100 will be located towards a rear of the footwear, in the region of the heel, and is held in that position by the adhesive pads.

In use, the insole 100 is placed in an item of footwear, towards the back, so that a wearer's heel will contact the heel cup 5 and the arch of a wearer will be contacted by the arched portion 2.

The insole can be made by many different methods and one example is as follows. The insole is manufactured by stamping and then pressing. Firstly, the insole is stamped to size and approximate shape from a sheet of copper-containing material. Following stamping, the blank produced from the stamping process is pressed—using appropriate tooling—to provide the contoured shape that can be seen in the figures. A third stage includes bevelling the edge and subsequent polishing to produce a smooth edge that will be comfortable for a wearer and not damage the inside of a piece of footwear or a wearer's foot.

Most preferably, the insole is produced in four sizes, which cover ladies' and gentlemens' footwear in all sizes.

Advantageously, the described invention has shown utility in providing an effect which can alleviate joint and arthritic pain.

The invention claimed is:

1. A foot orthotic for use as an insole in footwear to alleviate joint pain, said foot orthotic characterized in that the foot orthotic (i) is made of 99.9% copper;

(ii) is a three-quarter length orthotic adapted to be extended from a heel of a foot to a metatarsal head of said foot;

(iii) has a cup-shaped heel portion, a sloped portion longitudinally opposite the heel portion and an intermediate portion that defines a continual gradient that transitions between the heel portion and the sloped portion, wherein the heel portion has an outer periphery that defines a plane and the sloped portion curves away from the plane defined by the outer periphery, wherein the intermediate portion has peripheral edges, and wherein the sloped portion has left and right peripheral edges and a front peripheral edge;

(iv) has a peripheral edge which is beveled to define a continuous downturned edge that extends around the periphery of the heel portion, along the peripheral edges of the intermediate portion and along the left and right peripheral edges of the sloped portion; and (v) is bilaterally symmetrical about a longitudinal axis.

2. The foot orthotic as claimed in claim 1, wherein the foot orthotic is of uniform thickness.

3. The foot orthotic as claimed in claim 1 or 2, wherein the foot orthotic is made from a material of thickness from 0.5 mm to 1.5 mm.

4. The foot orthotic as claimed in claim 3, wherein the thickness is 1.0 mm or 1.2 mm.

5. The foot orthotic as claimed in claim 1, made by a process of stamping and pressing a blank of 99.9% copper.

6. The foot orthotic as claimed in claim 5, wherein the blank of 99.9% copper has been rolled.

7. The foot orthotic as claimed in claim 5, wherein the blank of 99.9% copper has been passed through a machine press.

8. The foot orthotic as claimed in claim 1, comprising an adhesive pad on an underside thereof, so as to reduce movement within a piece of footwear.

9. The foot orthotic as claimed in claim 1, wherein the foot orthotic comprises a stamped blank of 99.9% copper.

* * * * *